US006364638B1

(12) United States Patent
Liu

(10) Patent No.: US 6,364,638 B1
(45) Date of Patent: Apr. 2, 2002

(54) CEILING FAN STRUCTURE

(75) Inventor: Ching Wen Liu, Taichung (TW)

(73) Assignee: Pan Air Electric Co., Ltd., Taichung (TW)

( * ) Notice: Subject to any disclaimer, the term of this patent is extended or adjusted under 35 U.S.C. 154(b) by 0 days.

(21) Appl. No.: 09/677,515

(22) Filed: Sep. 29, 2000

(51) Int. Cl.[7] ..... F04B 17/00
(52) U.S. Cl. ..... 417/423.15; 416/5
(58) Field of Search ..... 417/423.15, 353, 417/354; 439/537; 392/361; 95/273; 416/5, 23

(56) References Cited

U.S. PATENT DOCUMENTS

| | | | | | |
|---|---|---|---|---|---|
| 4,391,570 | A | * | 7/1983 | Stutzman | 417/353 |
| 4,560,321 | A | * | 12/1985 | Kawai | 416/23 |
| 4,640,668 | A | * | 2/1987 | Yang | 417/354 |
| 4,720,241 | A | * | 1/1988 | Marwardt | 416/5 |
| 4,878,806 | A | * | 11/1989 | Marwardt | 416/5 |
| 5,443,625 | A | * | 8/1995 | Schaffhausen | 95/273 |
| 5,668,920 | A | * | 9/1997 | Pelonis | 392/361 |
| 6,074,182 | A | * | 6/2000 | Matson | 417/423.15 |
| 6,146,191 | A | * | 11/2000 | Kerr et al. | 439/537 |

FOREIGN PATENT DOCUMENTS

| | | | | |
|---|---|---|---|---|
| JP | 62121896 | * | 6/1987 | F04D/25/10 |

* cited by examiner

*Primary Examiner*—Teresa Walberg
*Assistant Examiner*—Leonid M Fastovsky
(74) *Attorney, Agent, or Firm*—Charles E. Baxley

(57) ABSTRACT

A ceiling fan structure includes a central shaft, a rotary disk having a pivot disk and a pivot base, a support bracket having two pairs of support bars each secured to the pivot base and two locking rings each mounted between two support bars for securing a hanging fan, a conducting power set having a conducting bushing secured on the central shaft, a support base secured on the rotary disk, and a plurality of conductors each secured on the support base and each electrically contacting with the conducting bushing for supplying electric power to the hanging fan, and a rotation retaining set having a gear secured on the central shaft, a U-shaped support bracket secured on the rotary disk, a support axle mounted in the support bracket, a reduction gear mounted on the support axle and meshing with the gear, a rubbing block mounted on the support axle and urged between the reduction gear and the upper support plate of the support bracket, and a spring mounted on the support axle and having a first end urged on the reduction gear and a second end urged on the lower support plate of the support bracket.

15 Claims, 8 Drawing Sheets

CEILING FAN STRUCTURE

BACKGROUND OF THE INVENTION

1. Field of the Invention

The present invention relates to a ceiling fan structure.

2. Description of the Related Art

A conventional ceiling fan in accordance with the prior art shown in FIG. 8 comprises a main shaft 61, a motor 60, a rotary disk 62, and a plurality of blades 63. The rotary disk 62 is rotated by the motor 61 so as to rotate the blades 63. However, each of the blades 63 has a fixed position and is rotated concentrically so that the direction of wind generated by rotation of the blades 63 is fixed and constant without variation, thereby decreasing the ventilating effect of the ceiling fan.

SUMMARY OF THE INVENTION

In accordance with one aspect of the present invention, there is provided a ceiling fan structure comprising:

a central shaft;

a rotary disk rotatably mounted on a lower end of the central shaft;

at least two hanging fans each secured on the rotary disk to rotate therewith;

a conducting power set mounted between the central shaft and the rotary disk and including:

a conducting bushing secured on the central shaft and electrically connected to a power supply;

a support base secured on the rotary disk and located beside the conducting bushing so that the support base is rotated with the rotary disk about the conducting bushing; and a plurality of conductors each secured on the support base to rotate therewith and each electrically contacting with the conducting bushing, each of the conductors electrically connected to the at least two hanging fans for supplying electric power to the at least two hanging fans; and a rotation retaining set mounted between the central shaft and the rotary disk and including:

a gear secured on the central shaft;

a substantially U-shaped support bracket secured on the rotary disk to rotate therewith and having an upper support plate and a lower support plate;

a support axle mounted in the support bracket and located between the upper support plate and the lower support plate;

a reduction gear mounted on the support axle and meshing with the gear;

a rubbing block mounted on the support axle and urged between the reduction gear and the upper support plate of the support bracket; and a spring mounted on the support axle and having a first end urged on the reduction gear and a second end urged on the lower support plate of the support bracket.

In accordance with another aspect of the present invention, there is provided a ceiling fan structure comprising:

a central shaft;

a rotary disk rotatably mounted on the central shaft and including a pivot disk pivotally mounted on a lower end of the central shaft, and a pivot base secured on the pivot disk to rotate therewith;

a support bracket mounted on the rotary disk and including at least two pairs of opposite parallel support bars each having a first end and a second end, the first end secured to the pivot base of the rotary disk to rotate therewith, and at least two locking rings each rotatably and adjustably mounted between the second ends of two adjacent support bars to move therewith; and at least two hanging fans each secured in the locking ring of the support bracket to move therewith.

In accordance with another aspect of the present invention, there is provided a ceiling fan structure comprising:

a central shaft;

a rotary disk rotatably mounted on the central shaft and including a pivot disk pivotally mounted on a lower end of the central shaft, and a pivot base secured on the pivot disk to rotate therewith;

a support bracket mounted on the rotary disk and including at least two pairs of opposite parallel support bars each having a first end and a second end, the first end secured to the pivot base of the rotary disk to rotate therewith, and at least two locking rings each rotatably and adjustably mounted between the second ends of two adjacent support bars to move therewith;

at least two hanging fans each secured in the locking ring of the support bracket to move therewith;

a conducting power set mounted between the central shaft and the rotary disk and including:

a conducting bushing secured on the central shaft and electrically connected to a power supply;

a support base secured on the rotary disk and located beside the conducting bushing so that the support base is rotated with the rotary disk about the conducting bushing; and a plurality of conductors each secured on the support base to rotate therewith and each electrically contacting with the conducting bushing, each of the conductors electrically connected to the at least two hanging fans for supplying electric power to the at least two hanging fans; and a rotation retaining set mounted between the central shaft and the rotary disk and including:

a gear secured on the central shaft;

a substantially U-shaped support bracket secured on the rotary disk to rotate therewith and having an upper support plate and a lower support plate;

a support axle mounted in the support bracket and located between the upper support plate and the lower support plate;

a reduction gear mounted on the support axle and meshing with the gear;

a rubbing block mounted on the support axle and urged between the reduction gear and the upper support plate of the support bracket; and a spring mounted on the support axle and having a first end urged on the reduction gear and a second end urged on the lower support plate of the support bracket.

Further benefits and advantages of the present invention will become apparent after a careful reading of the detailed description with appropriate reference to the accompanying drawings.

DETAILED DESCRIPTION OF THE INVENTION

Figure 1:
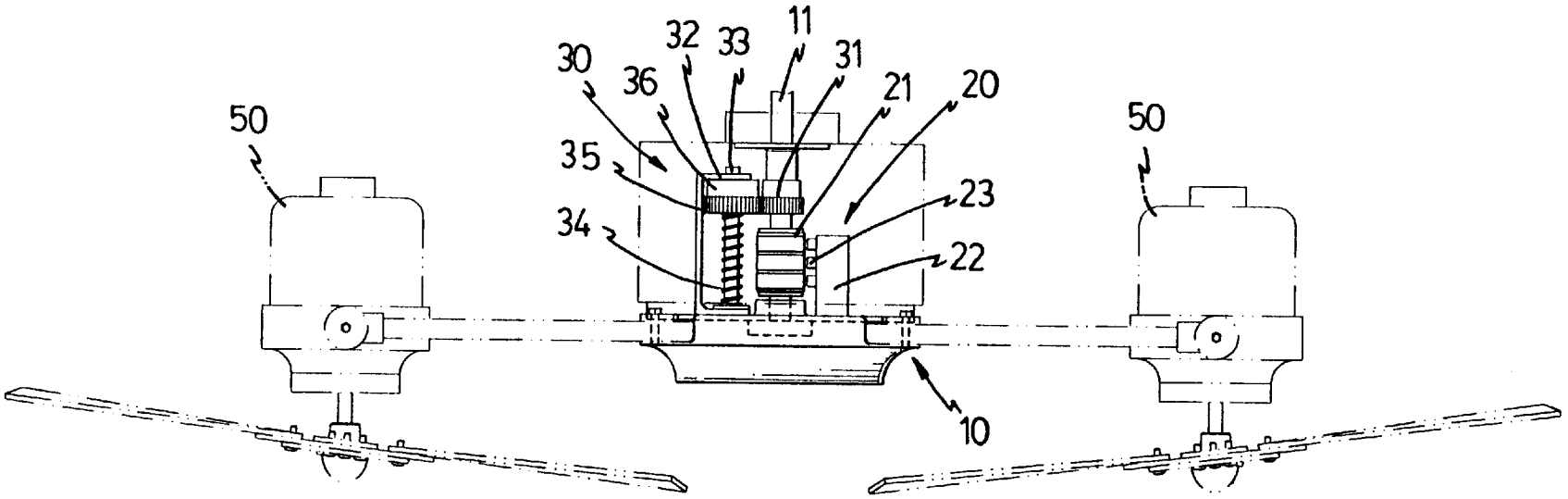
FIG. 1 is a front plan view of a ceiling fan structure in accordance with a first embodiment of the present invention.
Figure 2:
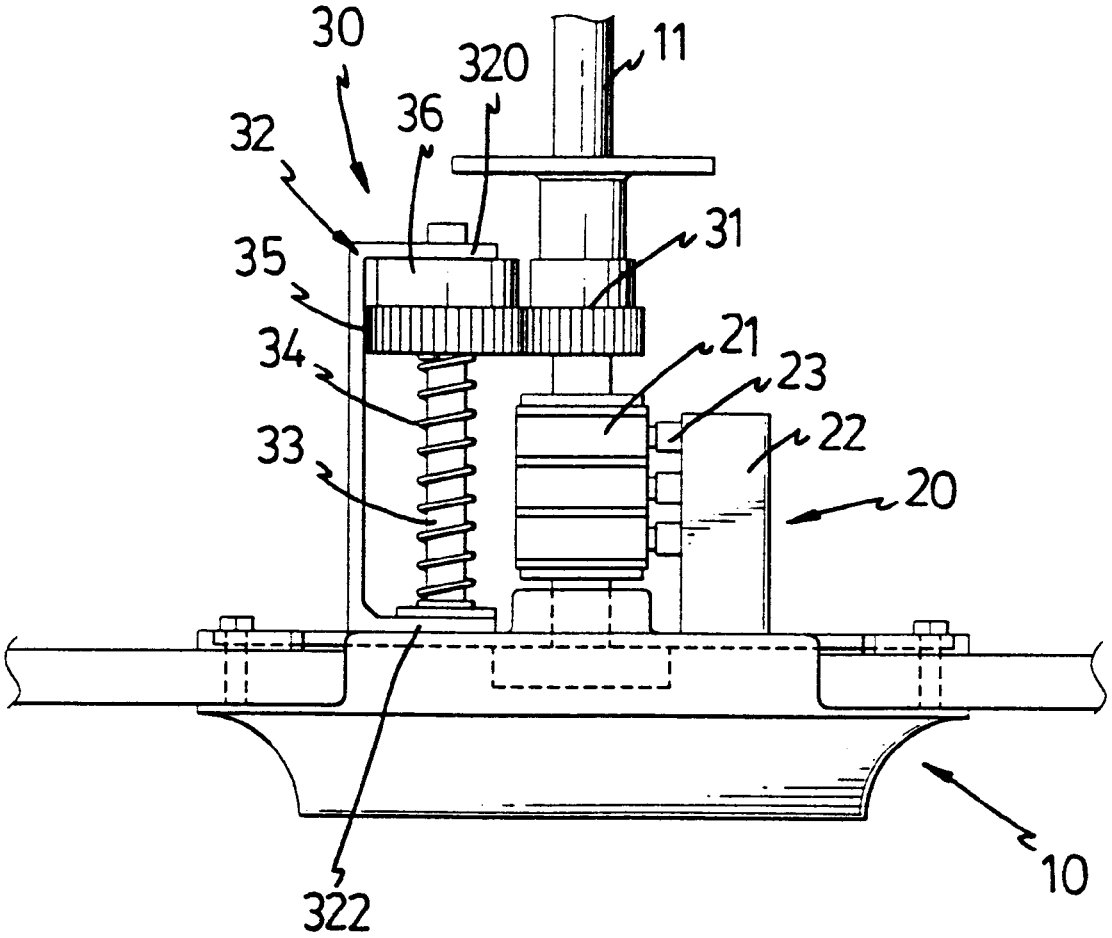
FIG. 2 is a partially enlarged view of the ceiling fan structure as shown in FIG. 1.
Figure 3:
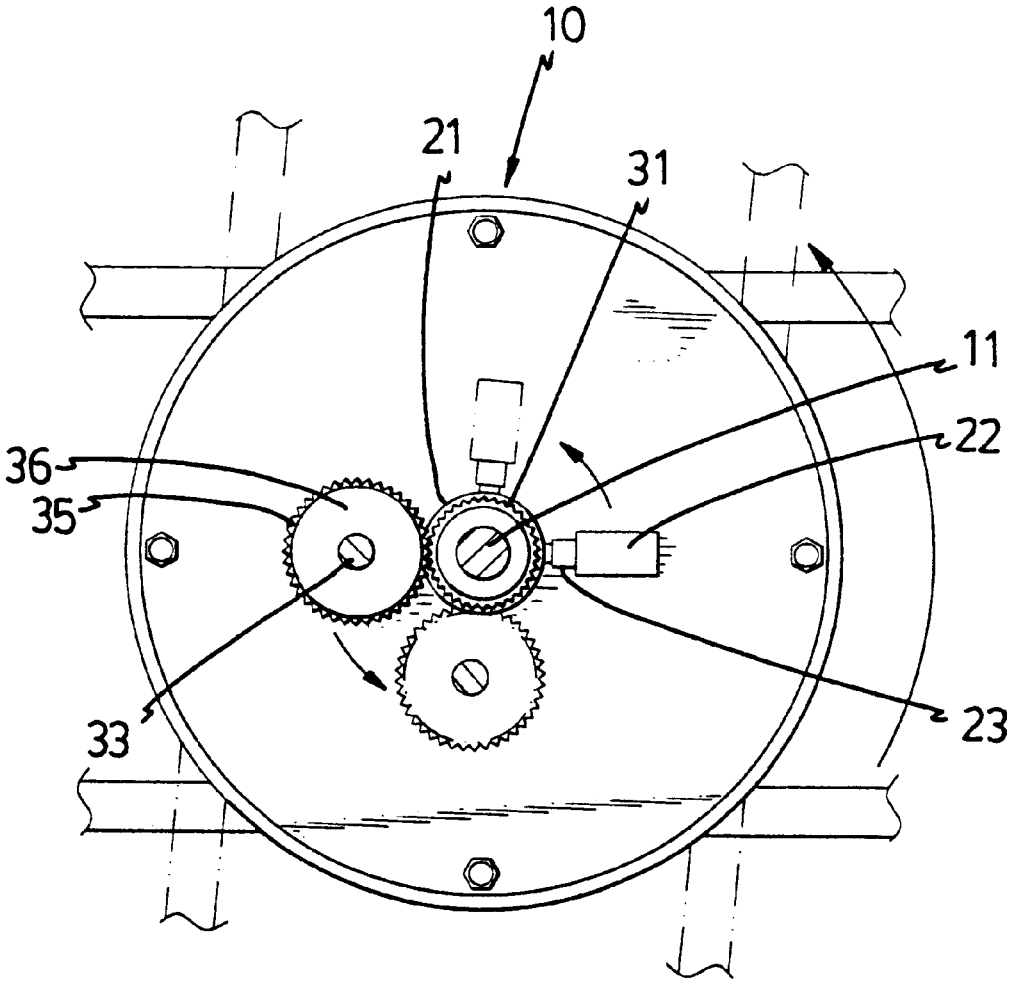
FIG. 3 is a partially cut-away top plan view of the ceiling fan structure as shown in FIG. 1.

Referring to the drawings and initially to FIGS. 1–3, a ceiling fan structure in accordance with a first embodiment of the present invention comprises a central shaft 11 having an upper end secured to the ceiling, a rotary disk 10 rotatably mounted on the lower end of the central shaft 11, two hanging fans 50 each secured on the rotary disk 10 to rotate therewith, a conducting power set 20, and a rotation retaining set 30.

The conducting power set 20 is mounted between the central shaft 11 and the rotary disk 10 and includes a conducting bushing 21 secured on the central shaft 11 and electrically connected to a power supply, a support base 22 secured on the rotary disk 10 and located beside the conducting bushing 21 so that the support base 22 is rotated with the rotary disk 10 about the conducting bushing 21, and a plurality of conductors 23 each secured on the support base 22 to rotate therewith and each electrically contacting with the conducting bushing 21. Each of the conductors 23 is electrically connected to the two hanging fans 50 for supplying electric power to the at least two hanging fans 50. Preferably, each of the conductors 23 of the conducting power set 20 is a telescopic member with a pre-set stress. Alternatively, each of the conductors 23 of the conducting power set 20 is an elastic reed.

The rotation retaining set 30 is mounted between the central shaft 11 and the rotary disk 10 and includes a gear 31 secured on the central shaft 11, a substantially U-shaped support bracket 32 secured on the rotary disk 10 to rotate therewith and having an upper support plate 320 and a lower support plate 322, a support axle 33 mounted in the support bracket 32 and located between the upper support plate 320 and the lower support plate 322, a reduction gear 35 mounted on the support axle 33 and meshing with the gear 31, a rubbing block 36 mounted on the support axle 33 and urged between the reduction gear 35 and the upper support plate 320 of the support bracket 32, and a spring 34 mounted on the support axle 33 and having a first end urged on the reduction gear 35 and a second end urged on the lower support plate 322 of the support bracket 32. in operation, the two hanging fans 50 are started to rotate when the switch is turned on. The reaction caused by the rotation of the two hanging fans 50 forces the rotary disk 10 to rotate about the central shaft 11. The conducting bushing 21 is secured on the central shaft 11 so that the conducting bushing 21 is not rotated while the support base 22 is rotated with the rotary disk 10 about the conducting bushing 21. The conductors 23 are rotated with the support base 22 and are kept in contact with the conducting bushing 21 constantly so that the electric power can be constantly transmitted from the conducting bushing 21 to the hanging fans 50 through the conductors 23 and will not be influenced by rotation of the support base 22 and the rotary disk 10.

When the rotary disk 10 is started to rotate about the central shaft 11, a larger rotational stress is exerted on the rotary disk 10 due to an inertial action and due to the adjustment of the self rotational speed of the hanging fans 50. At the same time, the reduction gear 35 meshes with the gear 31 and is urged by the spring 34 to press the rubbing member 36 which is urged on the upper support plate 320 of the support bracket 32, thereby generating friction which can be used to counteract the large rotational stress of the rotary disk 10 so that the rotary disk 10 can be rotated at a normal rotational speed.

Referring to FIGS. 4–7, a ceiling fan structure in accordance with a second embodiment of the present invention comprises a central shaft 11 having an upper end secured to the ceiling, a rotary disk 10, a support bracket 40, and two hanging fans 50.

The rotary disk 10 is rotatably mounted on the central shaft 11 and includes a pivot disk 15 pivotally mounted on the lower end of the central shaft 11, and a pivot base 12 secured on the pivot disk 15 to rotate therewith. The lower end of the central shaft 11 is provided with a positioning block 13 for supporting and limiting the pivot disk 15 of the rotary disk 10.

The support bracket 40 is mounted on the rotary disk 10 and includes two pairs of opposite parallel support bars 41 each having a first end and a second end, wherein the first end is secured to the pivot base 12 of the rotary disk 10 to rotate therewith, and two locking rings 42 each rotatably and adjustably mounted between the second ends of two adjacent support bars 41 to move therewith.

The pivot base 12 of the rotary disk 10 defines a plurality of positioning slots 17 for securing the first end of each of the support bars 41 of the support bracket 40 therein. The ceiling fan structure further comprises a plurality of positioning screws 16 each extending through the first end of the support bar 41 and through the positioning slot 17 for securing the first end of each of the support bars 41 of the support bracket 40 in the positioning slot 17 of the pivot base 12 of the rotary disk 10.

Each of the two hanging fans 50 includes a motor 51 secured in the locking ring 42 of the support bracket 40 to rotate therewith, a rotary rack 52 secured on the output axle 510 of the motor 51 to rotate therewith, and a plurality of blades 53 secured on the rotary rack 52 to rotate therewith.

Figure 7:
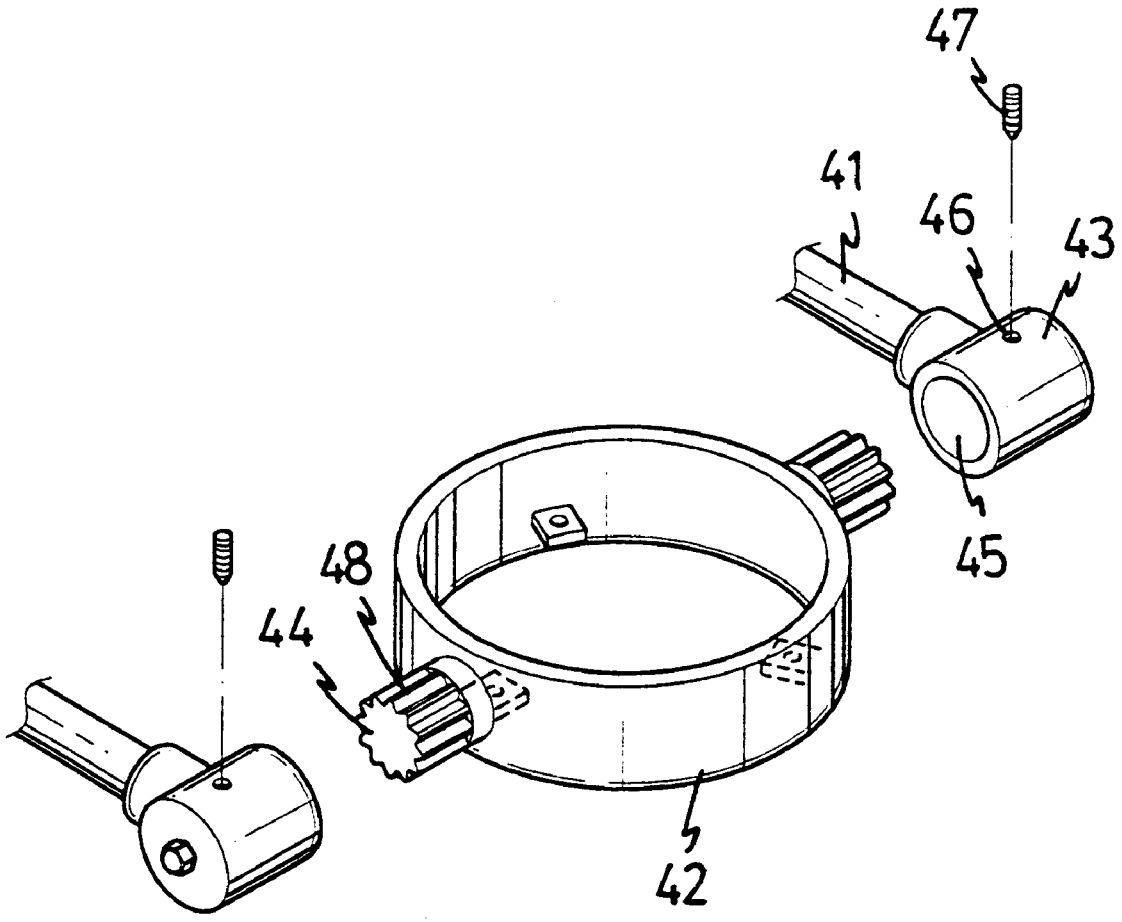
FIG. 7 is an exploded view of a locking ring and two support brackets of the ceiling fan structure as shown in FIG. 4.
Figure 8:
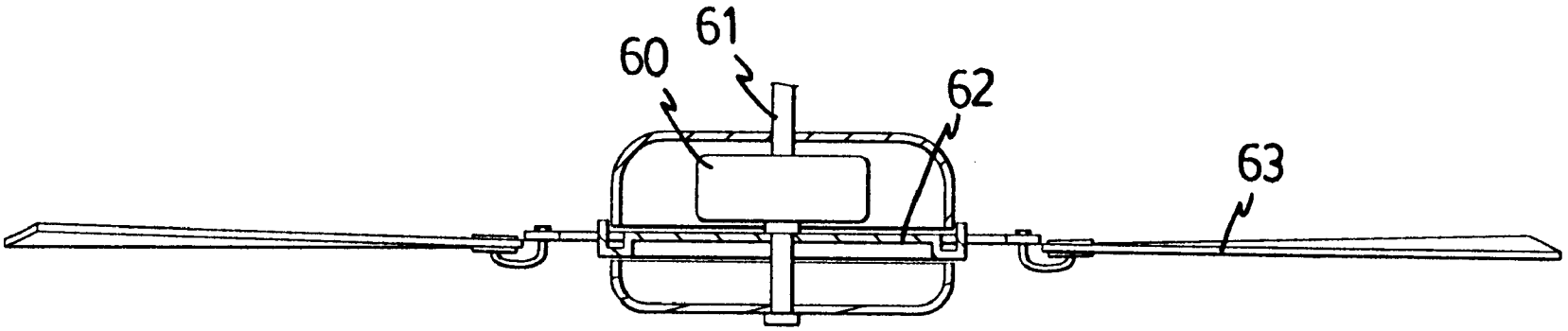
FIG. 8 PRIOR ART
FIG. 8 is a front plan cross-sectional view of a conventional ceiling fan in accordance with the prior art.

As shown in FIG. 7, the second end of each of the support bars 41 of the support bracket 40 is provided with a fixing tube 43 defining a receiving hole 45 and having a periphery defining a locking screw hole 46 connecting to the receiving hole 45. Each of the locking rings 42 of the support bracket 40 has two opposite sides each provided with a positioning post 44 rotatably mounted in the receiving hole 45 of the fixing tube 43 and having a periphery defining a plurality of locking notches 48. The ceiling fan structure further comprises a plurality of locking screws 47 each screwed in the locking screw hole 46 of the fixing base 43 of each of the support bars 41 of the support bracket 40 and each urged on one of the locking notches 48 of the positioning post 44 of each of the locking rings 42 of the support bracket 40.

In operation, the two hanging fans 50 are started to rotate when the switch is turned on. The reaction caused by the rotation of the two hanging fans 50 is transmitted to the support bracket 40 to force the rotary disk 10 to rotate about the central shaft 11.

In such a manner, each of the two hanging fans 50 is self rotated and is rotated relative to the central shaft 11, thereby changing the direction of the wind.

Figure 4:
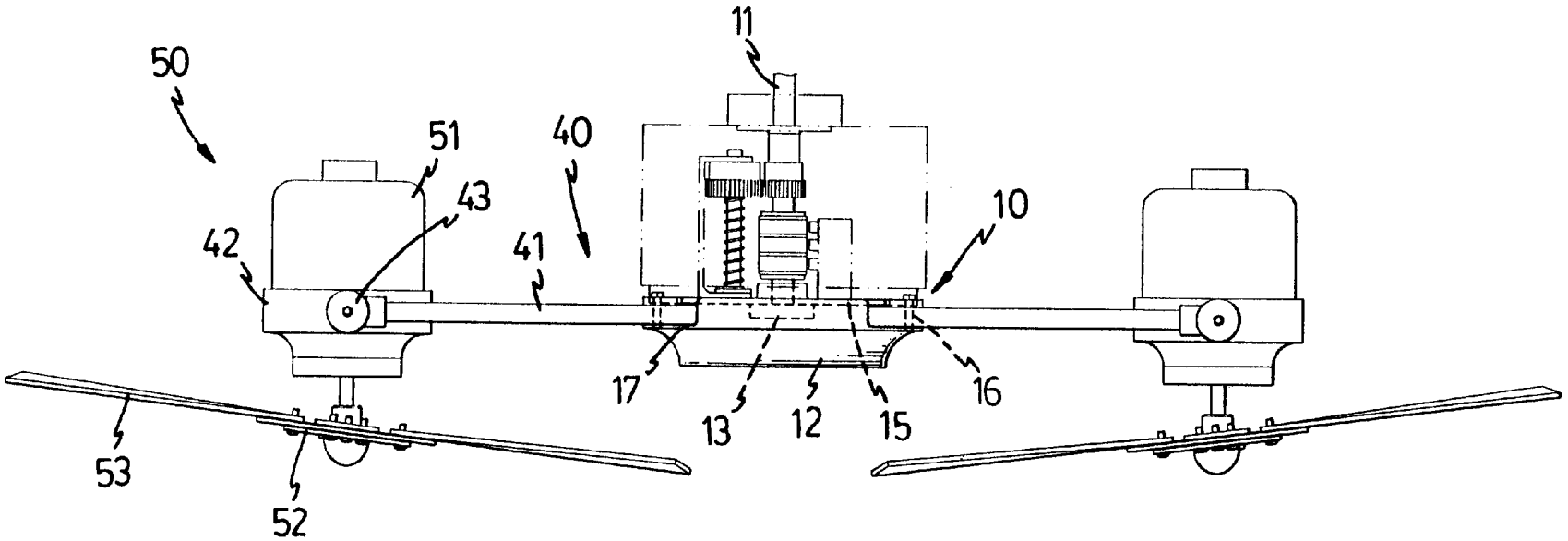
FIG. 4 is a front plan view of a ceiling fan structure in accordance with a second embodiment of the present invention.
Figure 5:
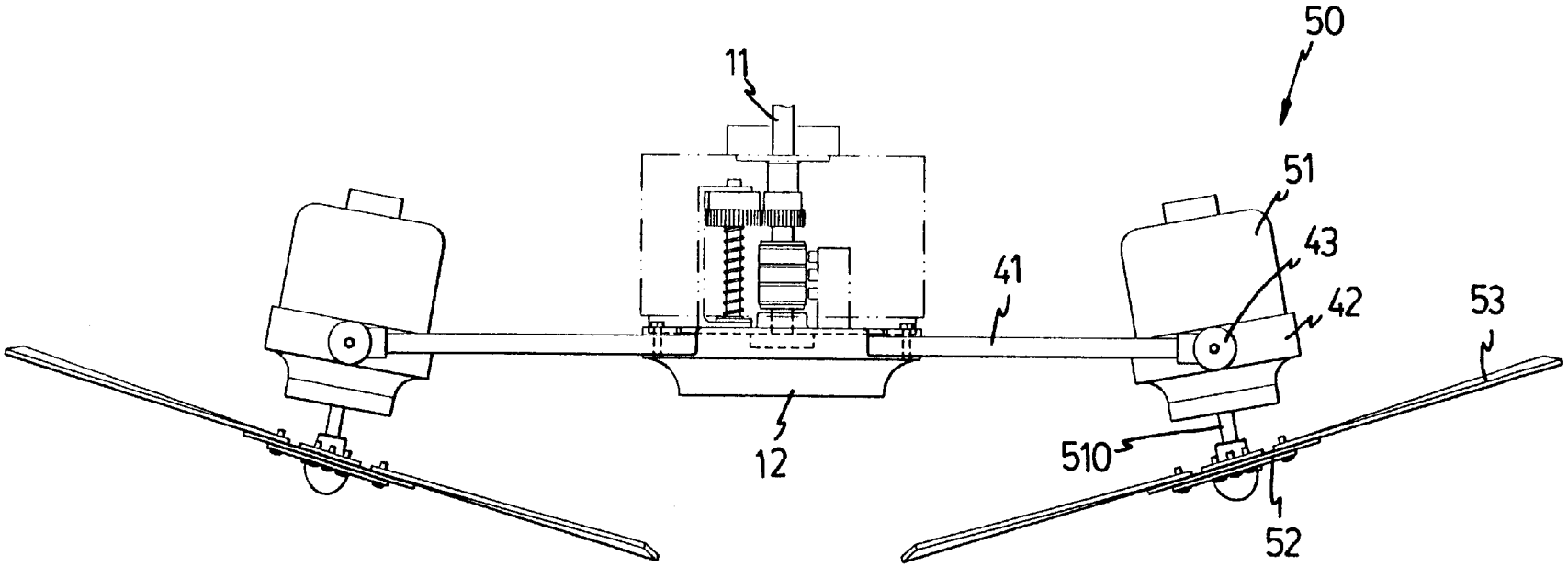
FIG. 5 is an operational view of the ceiling fan structure as shown in FIG. 4.
Figure 6:
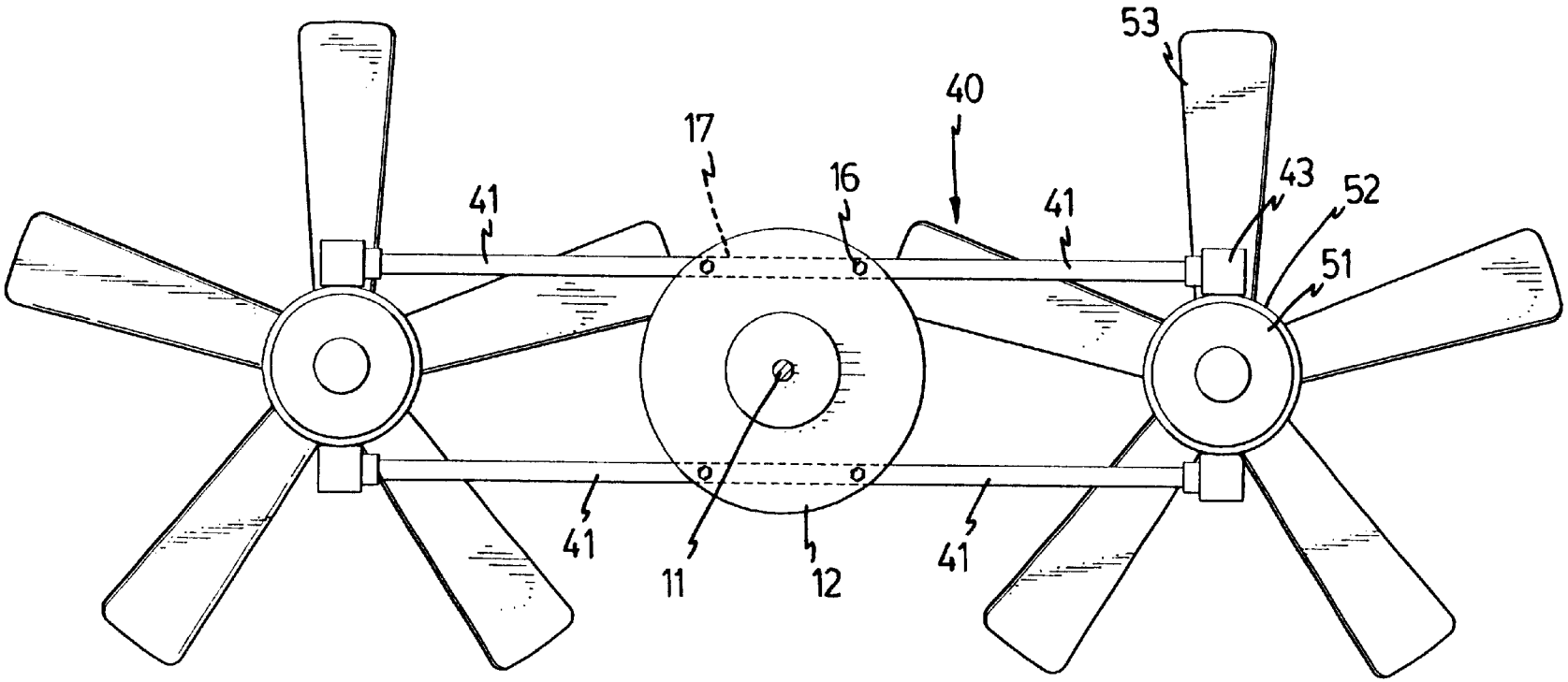
FIG. 6 is a top plan view of the ceiling fan structure as shown in FIG. 4.

The positioning post 44 of each of the locking rings 42 can be rotated in the receiving hole 45 of the fixing tube 43 of the support bar 41 so that the locking ring 42 can be rotated between the support bars 41 from the position as shown in FIG. 4 to the position as shown in FIG. 5, thereby adjusting the inclined angle of the locking ring 42 and the hanging fan 50.

It should be clear to those skilled in the art that further embodiments may be made without departing from the scope of the present invention.

What is claimed is:

1. A ceiling fan structure comprising:

a central shaft (11);

a rotary disk (10) rotatably mounted on a lower end of said central shaft (11);

at least two hanging fans (50) each secured on said rotary disk (10) to rotate therewith;

a conducting power set (20) mounted between said central shaft (11) and said rotary disk (10) and including:

a conducting bushing (21) secured on said central shaft (11) and electrically connected to a power supply;

a support base (22) secured on said rotary disk (10) and located beside said conducting bushing (21) so that said support base (22) is rotated with said rotary disk (10) about said conducting bushing (21); and a plurality of conductors (23) each secured on said support base (22) to rotate therewith and each electrically contacting with said conducting bushing (21), each of said conductors (23) electrically connected to said at least two hanging fans (50) for supplying electric power to said at least two hanging fans (50); and a rotation retaining set (30) mounted between said central shaft (11) and said rotary disk (10) and including:

a gear (31) secured on said central shaft (11);

a substantially U-shaped support bracket (32) secured on said rotary disk (10) to rotate therewith and having an upper support plate (320) and a lower support plate (322);

a support axle (33) mounted in said support bracket (32) and located between said upper support plate (320) and said lower support plate (322);

a reduction gear (35) mounted on said support axle (33) and meshing with said gear (31);

a rubbing block (36) mounted on said support axle (33) and urged between said reduction gear (35) and said upper support plate (320) of said support bracket (32); and a spring (34) mounted on said support axle (33) and having a first end urged on said reduction gear (35) and a second end urged on said lower support plate (322) of said support bracket (32).

2. The ceiling fan structure in accordance with claim 1, wherein each of said conductors (23) of said conducting power set (20) is a telescopic member with a pre-set stress.

3. The ceiling fan structure in accordance with claim 1, wherein each of said conductors (23) of said conducting power set (20) is an elastic reed.

4. A ceiling fan structure comprising:

a central shaft (11);

a rotary disk (10) rotatably mounted on said central shaft (11) and including a pivot disk (15) pivotally mounted on a lower end of said central shaft (11), and a pivot base (12) secured on said pivot disk (15) to rotate therewith;

a support bracket (40) mounted on said rotary disk (10) and including at least two pairs of opposite parallel support bars (41) each having a first end and a second end, said first end secured to said pivot base (12) of said rotary disk (10) to rotate therewith, and at least two locking rings (42) each rotatably and adjustably mounted between said second ends of two adjacent support bars (41) to move therewith; and at least two hanging fans (50) each secured in said locking ring (42) of said support bracket (40) to move therewith.

5. The ceiling fan structure in accordance with claim 4, wherein said pivot base (12) of said rotary disk (10) defines a plurality of positioning slots (17) for securing said first end of each of said support bars (41) of said support bracket (40) therein.

6. The ceiling fan structure in accordance with claim 5, further comprising a plurality of positioning screws (16) each extending through said first end of said support bar (41) and through said positioning slot (17) for securing said first end of each of said support bars (41) of said support bracket (40) in said positioning slot (17) of said pivot base (12) of said rotary disk (10).

7. The ceiling fan structure in accordance with claim 4, wherein said second end of each of said support bars (41) of said support bracket (40) is provided with a fixing tube (43) defining a receiving hole (45) and having a periphery defining a locking screw hole (46) connecting to said receiving hole (45), each of said locking rings (42) of said support bracket (40) has two opposite sides each provided with a positioning post (44) rotatably mounted in said receiving hole (45) of said fixing tube (43) and having a periphery defining a plurality of locking notches (48), and said ceiling fan structure further comprises a plurality of locking screws (47) each screwed in said locking screw hole (46) of said fixing base (43) of each of said support bars (41) of said support bracket (40) and each urged on one of said locking notches (48) of said positioning post (44) of each of said locking rings (42) of said support bracket (40).

8. The ceiling fan structure in accordance with claim 4, wherein said lower end of said central shaft (11) is provided with a positioning block (13) for supporting and limiting said pivot disk (15) of said rotary disk (10).

9. A ceiling fan structure comprising:

a central shaft (11);

a rotary disk (10) rotatably mounted on said central shaft (11) and including a pivot disk (15) pivotally mounted on a lower end of said central shaft (11), and a pivot base (12) secured on said pivot disk (15) to rotate therewith;

a support bracket (40) mounted on said rotary disk (10) and including at least two pairs of opposite parallel support bars (41) each having a first end and a second end, said first end secured to said pivot base (12) of said rotary disk (10) to rotate therewith, and at least two locking rings (42) each rotatably and adjustably mounted between said second ends of two adjacent support bars (41) to move therewith;

at least two hanging fans (50) each secured in said locking ring (42) of said support bracket (40) to move therewith;

a conducting power set (20) mounted between said central shaft (11) and said rotary disk (10) and including:

a conducting bushing (21) secured on said central shaft (11) and electrically connected to a power supply;

a support base (22) secured on said rotary disk (10) and located beside said conducting bushing (21) so that said support base (22) is rotated with said rotary disk (10) about said conducting bushing (21); and a plurality of conductors (23) each secured on said support base (22) to rotate therewith and each electrically contacting with said conducting bushing (21), each of said conductors (23) electrically connected to said at least two hanging fans (50) for supplying electric power to said at least two hanging fans (50); and a rotation retaining set (30) mounted between said central shaft (11) and said rotary disk (10) and including:

a gear (31) secured on said central shaft (11);

a substantially U-shaped support bracket (32) secured on said rotary disk (10) to rotate therewith and having an upper support plate (320) and a lower support plate (322);

a support axle (33) mounted in said support bracket (32) and located between said upper support plate (320) and said lower support plate (322);

a reduction gear (35) mounted on said support axle (33) and meshing with said gear (31);

a rubbing block (36) mounted on said support axle (33) and urged between said reduction gear (35) and said upper support plate (320) of said support bracket (32); and a spring (34) mounted on said support axle (33) and having a first end urged on said reduction gear (35) and a second end urged on said lower support plate (322) of said support bracket (32).

10. The ceiling fan structure in accordance with claim 9, wherein each of said conductors (23) of said conducting power set (20) is a telescopic member with a pre-set stress.

11. The ceiling fan structure in accordance with claim 9, wherein each of said conductors (23) of said conducting power set (20) is an elastic reed.

12. The ceiling fan structure in accordance with claim 9, wherein said pivot base (12) of said rotary disk (10) defines a plurality of positioning slots (17) for securing said first end of each of said support bars (41) of said support bracket (40) therein.

13. The ceiling fan structure in accordance with claim 12, further comprising a plurality of positioning screws (16) each extending through said first end of said support bar (41) and through said positioning slot (17) for securing said first end of each of said support bars (41) of said support bracket (40) in said positioning slot (17) of said pivot base (12) of said rotary disk (10).

14. The ceiling fan structure in accordance with claim 9, wherein said second end of each of said support bars (41) of said support bracket (40) is provided with a fixing tube (43) defining a receiving hole (45) and having a periphery defining a locking screw hole (46) connecting to said receiving hole (45), each of said locking rings (42) of said support bracket (40) has two opposite sides each provided with a positioning post (44) rotatably mounted in said receiving hole (45) of said fixing tube (43) and having a periphery defining a plurality of locking notches (48), and said ceiling fan structure further comprises a plurality of locking screws (47) each screwed in said locking screw hole (46) of said fixing base (43) of each of said support bars (41) of said support bracket (40) and each urged on one of said locking notches (48) of said positioning post (44) of each of said locking rings (42) of said support bracket (40).

15. The ceiling fan structure in accordance with claim 9, wherein said lower end of said central shaft (11) is provided with a positioning block (13) for supporting and limiting said pivot disk (15) of said rotary disk (10).

* * * * *